US005111639A

United States Patent [19]

Bolejack et al.

[11] Patent Number: 5,111,639

[45] Date of Patent: May 12, 1992

[54] METHOD AND APPARATUS FOR BAGGING PRODUCT UNITS

[75] Inventors: Kevin J. Bolejack; Frederick Forgnone, both of Salinas, Calif.

[73] Assignee: Transfresh Corporation, Salinas, Calif.

[21] Appl. No.: 675,741

[22] Filed: Mar. 27, 1991

Related U.S. Application Data

[62] Division of Ser. No. 311,225, Feb. 15, 1989, Pat. No. 5,046,302.

[51] Int. Cl.[5] ..... B65B 31/04

[52] U.S. Cl. ..... 53/408; 53/434; 53/79; 53/250; 53/571

[58] Field of Search ..... 53/459, 457, 434, 433, 53/447, 408, 403, 405, 79, 512, 511, 251, 250, 386.1, 529, 571

[56] References Cited

U.S. PATENT DOCUMENTS

| | | | |
|---|---|---|---|
| 3,584,428 | 6/1971 | Falk | 53/391 X |
| 3,648,433 | 3/1972 | Owen | 53/390 X |
| 3,852,937 | 12/1974 | Bitsura et al. | 53/386.1 X |
| 4,055,931 | 11/1977 | Myers | 53/408 |
| 4,575,989 | 3/1986 | Hannen | 53/434 |
| 4,821,489 | 4/1989 | MacLeod et al. | 53/419 |

*Primary Examiner*—James F. Coan

[57] ABSTRACT

A method and apparatus are disclosed for sealing pallets of fresh product inside plastic bags and finishing the interiors of the sealed bags with a modified gaseous atmosphere. Conventional pallets loaded with cooled fresh produce are moved by an input conveyor automatically one at a time to an in-line squeeze station. A plastic bag at a convenient height is initially draped over an arm radiating from a novel bagger frame. A plurality of such arms extend from a rotatable hub so that bags can be moved into position above successive loaded pallets as they are needed. This apparatus permits the bagging of nearly twice as many pallets in a given time period.

31 Claims, 5 Drawing Sheets

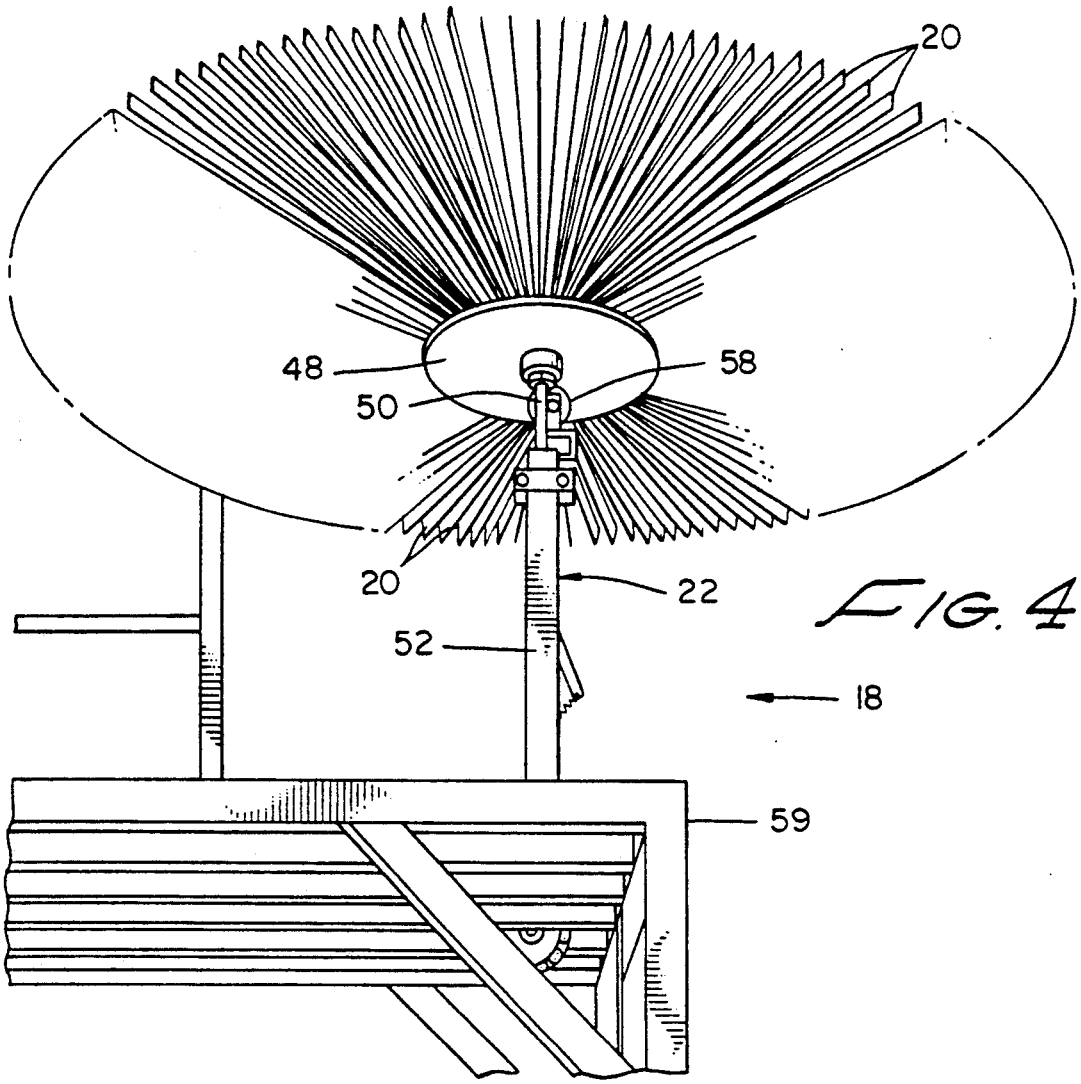
FIG. 4
FIG. 6
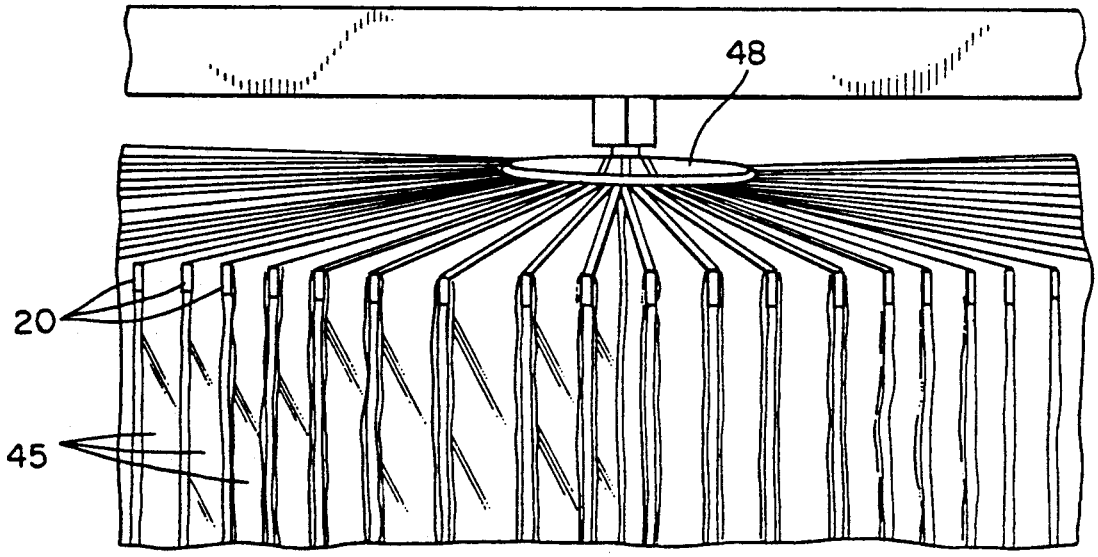

METHOD AND APPARATUS FOR BAGGING PRODUCT UNITS

This application is a division of U.S. Pat. application Ser. No. 07/311,225 filed on Feb. 15, 1989, now U.S. Pat. No. 5,046,302 in the name of Kevin J. Bolejack and Frederick Forgnone entitled "Method and Apparatus for Bagging Product Units".

BACKGROUND OF THE INVENTION

1. Field of the Invention

The invention relates to the field of bagging product units on a production line, and in particular to a method and apparatus for bagging agricultural produce pallets in preparation for modifying the atmosphere surrounding the produce inside the bag with a gas or gas mixture to retard ripening and spoilage, or to otherwise promote freshness and extend the shelf life of such produce.

2. Description of the Related Art

The ripening of agricultural produce such as tomatoes or peaches is affected by the atmosphere surrounding the produce. Many foodstuffs, such as fresh produce (e.g., strawberries, lettuce, tomatoes, cauliflower), can have their fresh condition maintained for an extended period of time by controlling the gaseous atmosphere inside the package in which they are contained. Losses during shipment and storage can be substantially decreased in this manner so that a greater percentage of fresh produce can be delivered to the consumer in acceptable condition.

Many kinds of fresh produce, a primary one being strawberries, are shipped in a quantity of boxes on a pallet base, with the entire load being enclosed by a plastic bag that is sealed to the base. U.S. Pat. No. 4,055,931, which is hereby incorporated herein by reference, discloses the providing of a special atmosphere into the containing space formed by the plastic bag by first inserting a sharp-ended nozzle through the plastic sheeting, evacuating the air inside the bag, and introducing gases into the interior. U.S. patent application Ser. No. 06/428,087, filed Sept. 29, 1982, now U.S. Pat. No. 4,821,489 entitled "Method and Apparatus for Sealing a Flexible Bag to a Pallet," by Richard F. MacLeod and Kevin J. Bolejack, assigned to the assignee of the present Application, is hereby also incorporated herein by reference. It discloses a method and apparatus described briefly as follows. Produce is stacked in one or more boxes onto a pallet base having an oversized, gasproof plastic sheeting integrally related to the pallet base upper surface. The loaded pallet is placed on a rotatable table having a generally horizontal upper surface and a plastic bag is lowered over the produce which has its lower edges located to extend partway down over the turned portions of the plastic sheeting and onto the rim of the pallet base. Two rolls of tape are mounted at different heights on vertical spindles closely adjacent the rotating table and are located so that when the tape is pulled off the spindles, the two tape strips will have an edge portion in overlapping relationship with each other. An idler roller engages the two strips of tape at two different predetermined angles joining them together in a single composite tape strip. The composite tape strip is applied by a pressure roller along the lower edge of the plastic bag and the upturned plastic sheeting edge. After a full revolution of the table is completed, the tape is cut and the bag is completely sealed to the plastic sheeting. A lever arm on the pressure roller is spring-loaded so as to maintain the tape compressingly contacting the plastic bag and pallet throughout the full range of table rotation. Once the bag has been sealed, a sharp-ended nozzle punctures the bag, the bag is evacuated to remove residual air, and a prescribed pressurized gas is injected into the bag. The nozzle is then removed and the opening in the bag is taped closed.

The present approach taken in that part of the process involving securing the plastic bag over the produce and onto the pallet base has been found to be deficient in certain respects. Considerable floor space and worktime are needed in the step of slipping a plastic bag over a pallet and fastening its edges to the plastic sheeting of the pallet base. A bag must first be prepared for slipping over the pallet by expanding it to an open shape into which the pallet can enter as the bag is pulled downward over it. This is done by walking the bag around the room to fill it with air before it can be slipped over the top of the loaded pallet, and requires an appropriate amount of floor space. Two workers are required to manipulate the bag in opening it up, placing it with its opening facing downward above the top of the pallet, sliding it downward over the full height of the pallet, and smoothing and arranging the free edges of the bag in relation to the plastic pallet sheeting preparatory to the taping and sealing carried out in the next stage of the process. Using the present system about 15 pallets can be bagged, gassed, and sealed in roughly 45 minutes utilizing at least ten workers. It would be an advance in the art of produce preservation and packaging if the amount of space required for the operation, the number of personnel needed, and the time it takes could all be reduced.

SUMMARY OF THE INVENTION

A method and apparatus are disclosed for enclosing pallets of fresh produce in sealed bags and furnishing the interiors of the sealed bags with a modified gaseous atmosphere for preserving such produce. Conventional pallets loaded with fresh produce are transported from cooling tunnels to an input conveyor. The input conveyor moves the pallets automatically one at a time to an in-line squeeze station. When a pallet is positioned on the squeeze station the conveyor stops automatically. The produce load of a pallet positioned at the squeeze station is squeezed between opposed vertical walls to suspend it above the pallet base as a downwardly movable floorplate descends to allow the base to be removed and replaced with a pallet having a plastic sheet lining attached thereto. Then the floorplate is raised to its former level to bear the weight of the loaded pallet as the pallet is unsqueezed. Next the loaded pallet with its plastic-covered base is moved by conveyor to a bagging station. The free edges of the plastic sheeting are folded upward and attached to the trays on the first tier of the pallet, and the mouth of a plastic bag is drawn downward over the top of the loaded pallet. The bag is initially draped over an arm radiating from a bagger frame which keeps a supply of bags draped over a plurality of such radial arms at a convenient height. The arms extend from a rotatable hub so that bags can be moved into position above successive loaded pallets as they are needed. This apparatus permits the bagging of nearly twice as many pallets as before in a given time period. Following the bagging step the bagged pallet is moved to a turntable and sealed by rotation against spring-loaded overlapping strips of tape. After being moved, preferably automatically, to a gassing station, the sealed bag surrounding the produce is first evacuated and then filled with a suitably modified atmosphere to preserve the freshness of the produce. A preferred method for bag evacuation and subsequent gas filling in the Tectrol Atmosphere Injection System employs the insertion of nozzle means through the plastic bag. Gases inside the bag are first removed with vacuum means and then replaced with a spoilage-retardant modified gaseous atmosphere. The hole punctured in the bag by the inserted nozzle is sealed, preferably with a patch of tape. The gassed pallet is reoriented through 90° by a repositioning turntable and sent down an inclined portion of roller-surfaced table to a pallet exit area for removal, preferably by forklift. In addition to allowing the processing of more units in a given time period than is possible with present systems, the method and apparatus of the invention require fewer workers to effect the improved results.

BRIEF DESCRIPTION OF THE DRAWINGS

The various features and advantages of the present invention will become apparent in light of the following detailed description taken together with the accompanying drawings, in which:

FIG. 4 is a perspective view from below of the pallet bagger apparatus without bags;

FIG. 6 is a fragmentary perspective view of the pallet bagger; and

DESCRIPTION OF THE PREFERRED EMBODIMENTS

The method and apparatus of the present invention will be described in terms of pallets loaded with strawberries, although only minor modifications in the sizing of the apparatus is necessary for application to other types of produce. A plurality of strawberry packages are initially stacked onto the upper surface of a pallet constructed of wood and comprising five slats on three runners. A fully loaded pallet contains 16 tiers of 6 trays in each tier and has an overall height of about 88 inches. Each tray contains 12 one-pint baskets of strawberries, so that a fully loaded pallet has 96 dozen pint baskets of strawberries. A strawberry pallet is 39 inches by 39 inches, whereas all other produce pallets are 40 inches by 48 inches. Eight loaded pallets are accommodated in a cooling tunnel at one time where the strawberries are cooled to around 33° F., which is about 4° above the freezing point of the strawberries depending on their sugar content. The gassing operation is only done on cold produce.

Figure 1:
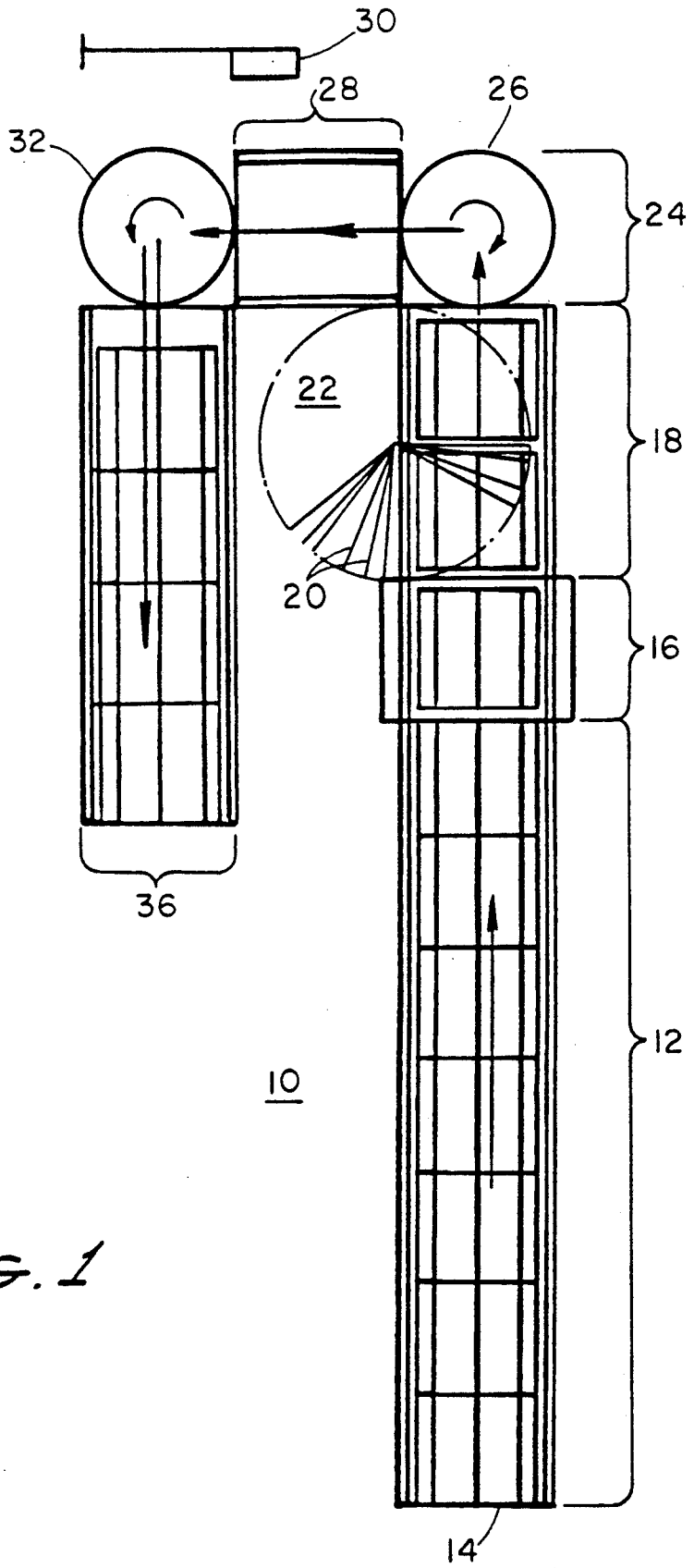
FIG. 1 is a schematic plan view of the layout of the pallet bagging and sealing system.

FIG. 1 is a schematic plan view of the layout of the bagging apparatus 10 of the invention. An infeed portion 12 of apparatus 10 comprises a conveyor line using metal rollers which are actuated by a belt drive. Eight pallets are brought by forklift from a cooling tunnel and unloaded at infeed 14 of the conveyor line. When the first loaded pallet reaches a pallet squeeze station 16 the drive mechanism for the conveyor line is automatically shut off. Pallet squeeze station 16 comprises a hydraulically actuated pair of opposed vertical walls above a pneumatically actuated floorplate. An operator manually activates the hydraulically actuated vertical walls, one of which approaches the other by a distance calculated to squeeze the pallet load a sufficient amount to support it against the force of gravity. The floorplate on which the loaded pallet normally rests is pneumatically moved downward to allow removal of the conventional wooden pallet base and replacement of it with a pallet which has a generally rectangular plastic sheet that underlies the pallet top layer and is thus incorporated into the pallet construction. The sheet is generally flat and its edge margins are formed upwardly into a generally tray or open pan shape. The floorplate is then raised to its original position to support the pallet load, the pallet load is unsqueezed, and the loaded Tectrol pallet is moved to pallet bagging station 18.

Pallet bagging station 18 comprises a work area which will accommodate two loaded pallets, above which, at a convenient height, are rotatable arm-like extensions 20 which form part of a pallet bagger frame 22. A plurality of plastic bags are folded or draped over extensions 20 so that the bag openings are at a height just greater than the top of a loaded pallet. Two workers are employed at pallet bagging station 18 in bagging the loaded pallets after the pallets have left pallet squeeze station 16. The upwardly formed edge margins of the plastic sheet on each pallet are stapled to the trays on the first tier of the pallet load in preparation for the bagging step. Bagging is done by pulling the opening of a bag lying draped on one of the extensions 20 over the top of the pallet load and downward to the base of the pallet. The free edges of the bag are made to overlap the stapled edges of the plastic sheet of the pallet base.

A bagged pallet prepared in this manner is then moved by conveyor rollers to a rotary tape sealing station 24, where the overlapping margins of the bag and the plastic sheet are sealed with tape. Rotary tape sealing station 24 comprises a turntable 26 on which the pallet is held against tape as turntable 26 rotates to seal the bag to the plastic sheet of the pallet base. After sealing is effected, the bagged pallet is transferred to gassing area 28 where a nozzle from an MA350 Tectrol Atmosphere Injection Unit 30 is inserted through a bag wall into the interior. First the interior gases in the sealed bag are evacuated through the nozzle forming a partial vacuum within the bag, and then a prescribed gas is injected or drawn into the bag by partial vacuum. The nozzle is then withdrawn and the opening in the bag is closed with a patch of tape. Finally the bagged, sealed, and gassed pallet is transferred to repositioning turntable 32, rotated through 90°, and sent down an inclined table 34 with rollers to be stopped at off-feed area 36.

Figure 2:
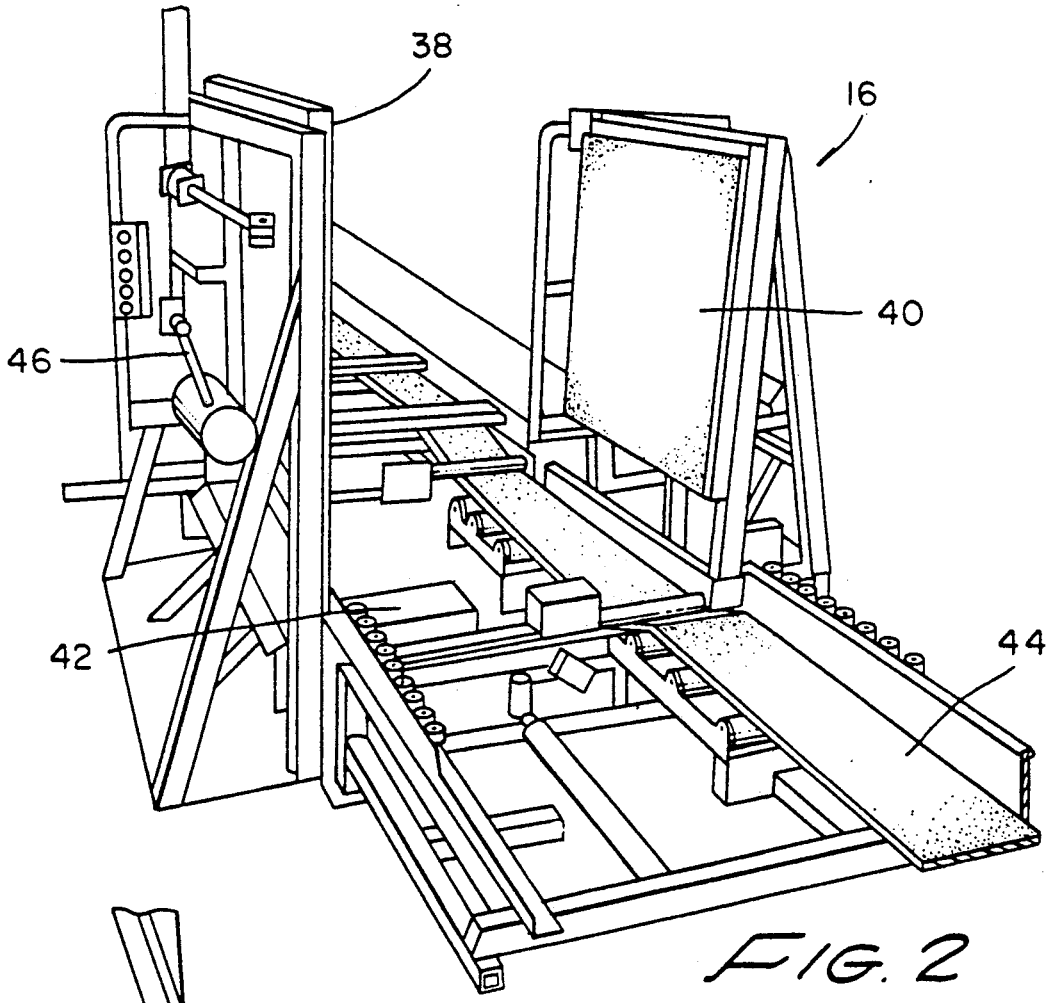
FIG. 2 is a perspective view of the apparatus of the squeeze station.
Figure 3:
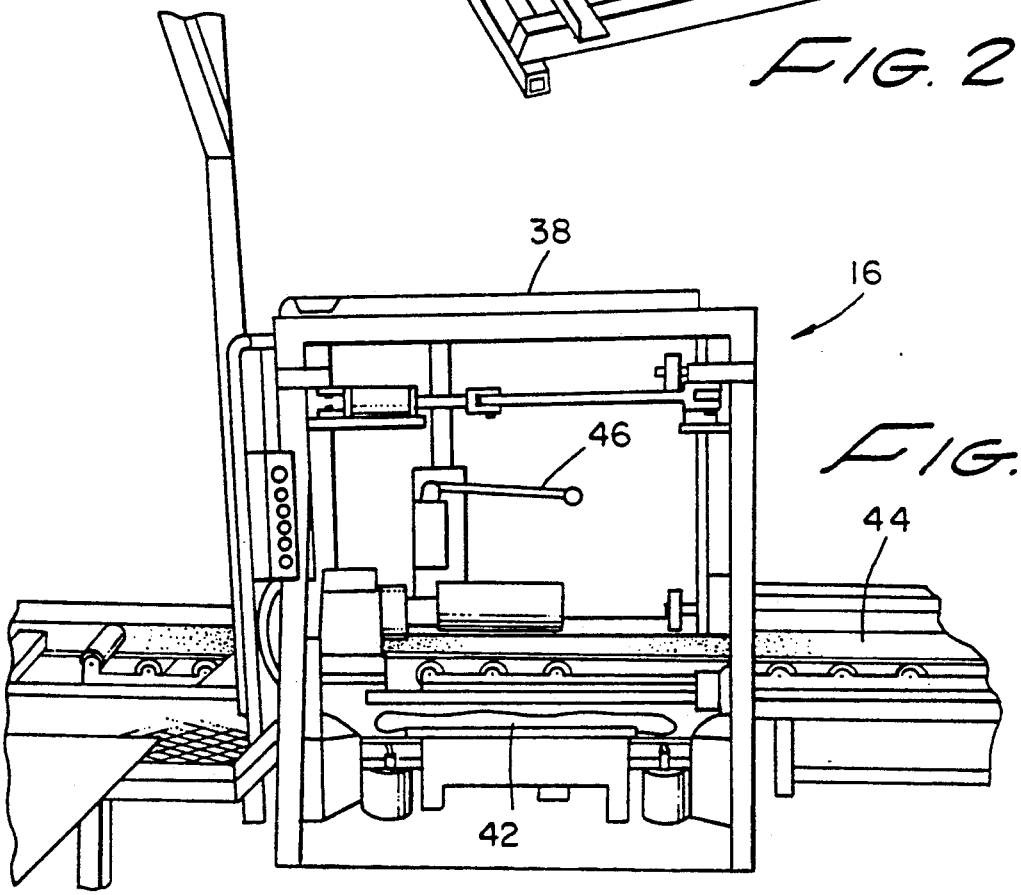
FIG. 3 is a side view of the apparatus of the squeeze station.

Referring to FIG. 2, which is a perspective view of the apparatus of squeeze station 16, certain details of the apparatus may be seen. Hydraulically actuated opposed vertical walls 38 and 40 flank a space above pneumatically actuated floorplate 42. When floorplate 42 is in its raised position the loaded pallet is brought into the space on conveyor belt 44. Wall 40 is moved hydraulically toward wall 38 to squeeze the pallet load a sufficient amount to support it against the force of gravity. The operator manually activates the hydraulically actuated vertical walls 38 and 40 by turning lever 46. Lever 46 is shown more clearly in FIG. 3, which is a side view of the apparatus of the squeeze station 16.

Floorplate or deckplate 42, on which the loaded pallet normally rests, is pneumatically moved downward to allow the conventional wooden pallet base to be removed and replaced with a pallet which has a plastic sheet underlying the pallet top layer and integrally incorporated into the pallet construction. Floorplate 42 is then raised to its original position to support the pallet load, the pallet load is unsqueezed, and the loaded plastic-covered pallet is moved on conveyor belt 44 to pallet bagging station 18.

Figure 5:
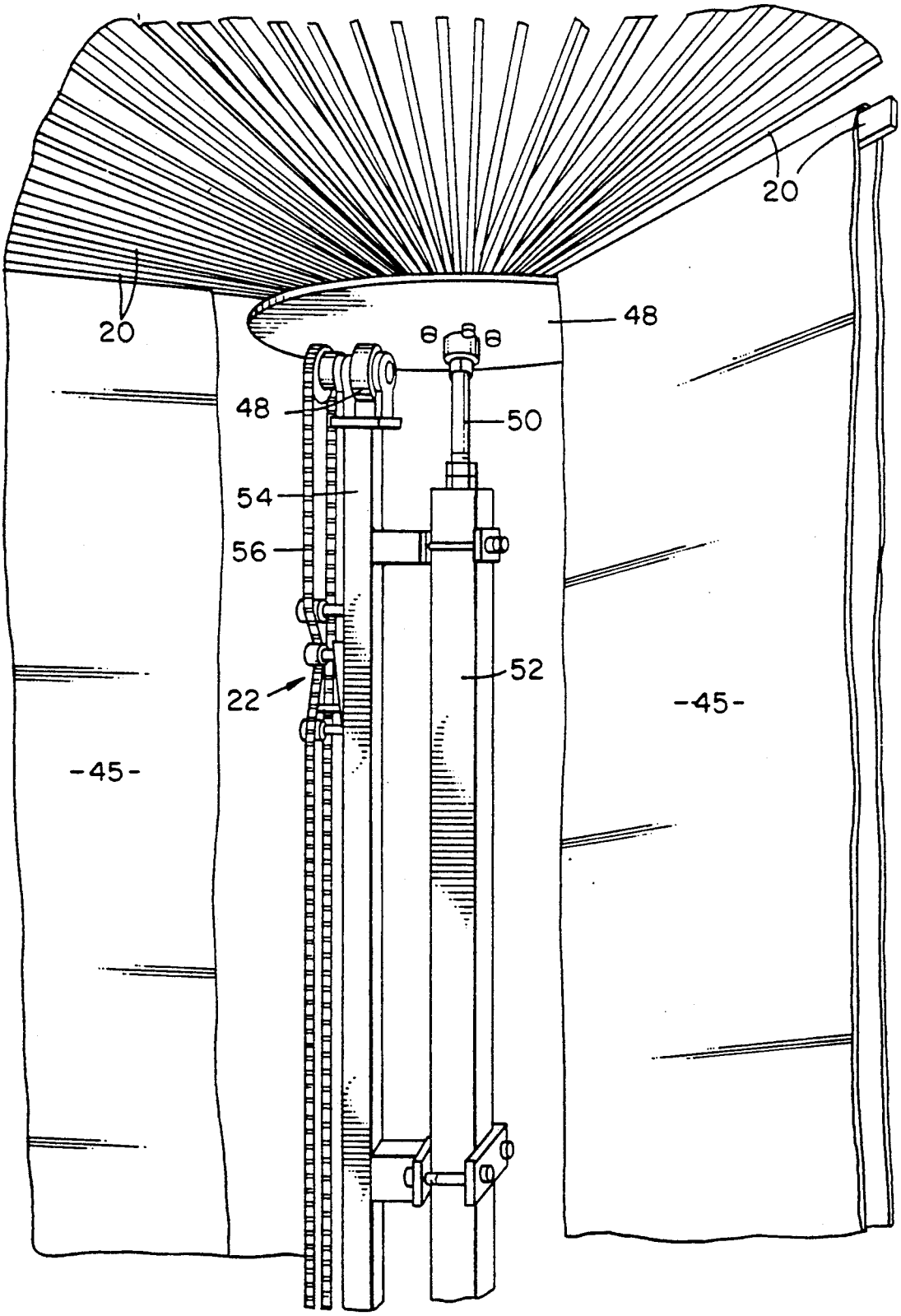
FIG. 5 is a side perspective view of the pallet bagger apparatus with bags folded over and hanging from some of the arms.

FIG. 4 is a perspective view from below of part of pallet bagging station 18, namely the pallet bagger frame 22 with its arm-like extensions 20 over which a plurality of plastic bags 45 are folded or draped. FIG. 5 is a side perspective view of the pallet bagger frame 22 with bags 45 folded over and hanging from some of the arms. Each bag 45 is draped over an extension 20 so that half of the bag 45 hangs to each side. Extensions 20 radiate from a hub 48 on the end of a central rotatable shaft 50 which turns in a bearing mounted inside post 52. A drive arrangement mounted on a vertical frame member 54 parallel to post 52 includes a chain drive 56 which rotates a rubber wheel 58 in frictional contact with the underside of hub 48. The lower end of chain drive 56 (not shown) is accessible to an operator standing underneath frame 22 so that hub 48 can be rotated by hand to bring fresh bags 45 into place over the work area of pallet bagging station 18 as successive loaded pallets are bagged. In an alternative arrangement the incremental rotation of hub 48 could be effected by any one of a number of automatic drive arrangements which are known in the art, such as through the use of a stepping motor to drive chain drive 56. Details of how the bags 45 are folded over the radial arms 20 of the bagger frame 22 are shown in FIG. 6, which is a fragmentary perspective view of the pallet bagger apparatus.

The plurality of arm-like extensions 20 numbers about 200. The extensions 20 are loaded up with bags 45 before a bagging session begins by a worker who mounts a platform 59 (shown in FIG. 4) permitting access to extensions 20. The bags 45 lie draped over extensions 20 with their openings just above the level corresponding to the top of the loaded pallets.

Figure 7:
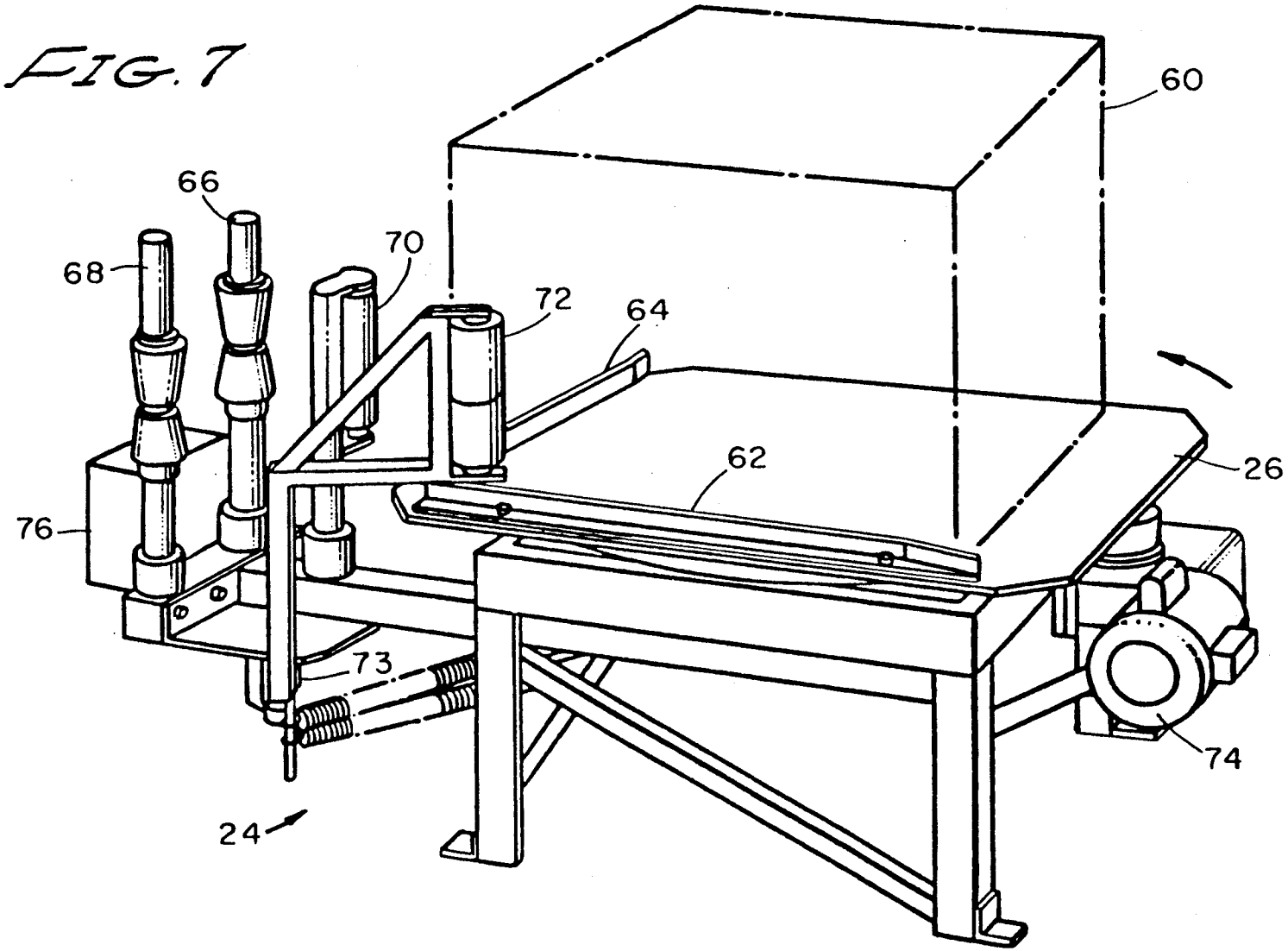
FIG. 7 is a perspective view of the apparatus of the taping and sealing station.

FIG. 7 is a perspective view of the apparatus of the taping and sealing station, which is described in detail in U.S. patent application Ser. No. 06/428,087, filed Sep. 29, 1982, entitled "Method and Apparatus for Sealing a Flexible Bag to a Pallet," referred to above. Briefly, referring to FIG. 7, the loaded pallet 60 is conveyed after being bagged to sealing apparatus 24 and located on turntable 26, the pallet side edges being approximately squared with the upstanding walls 62 and 64. Turntable 26 has a generally horizontal upper surface. A composite tape strip is pulled by hand toward the container 60 and affixed by hand to the container adjacent a corner and positioned vertically so as to cover both the upper edge of the plastic sheet and the outer edges of the plastic sheeting that forms part of the pallet. Two rolls of tape are mounted at different heights on vertical spindles 66 and 68 closely adjacent rotating table 26 and are located so that when the tape is pulled off the spindles 66 and 68, the two tape strips will have an edge portion in overlapping relationship with each other. An idler roller 70 engages the two strips of tape at two different predetermined angles joining them together in a single composite tape strip. The composite tape strip is applied by a pressure roller 72 along the lower edge of the plastic bag and the upturned plastic sheeting edge. After a full revolution of turntable 26 is completed, the tape is cut and the bag is completely sealed to the plastic sheeting. A lever arm 73 on the pressure roller is spring-loaded so as to maintain the tape compressingly contacting the plastic bag and pallet throughout the full range of table rotation. A power source 74 is energized by actuating switch 76 and the turntable 26 driven for at least one full revolution, during which time tape is pulled off the two rolls on 66 and 68 and pressed as a composite tape onto the container 60 by continuous pressure from pressure roller 72. At the completion of taping, the rotational drive ceases by automatic or manual control and the tape is cut.

The above-described embodiments are furnished as illustrative of the principles of the invention, and are not intended to define the only embodiments possible in accordance with our teaching. Rather, the invention is to be considered as encompassing not only the specific embodiments shown, but also any others falling within the scope of the following claims.

What is claimed is:

1. A method of bagging a plurality of pallet-borne pluralities of packages containing perishables in a process for sealing an open plastic bag to a plastic sheet joined to a pallet base to provide a gastight container for said perishables, comprising:

draping, a plurality of folded bags over horizontal members of a pallet bagger frame above a bagging station such that each of said horizontal members supports only one of said bags;

positioning each of said plurality of pallet-borne pluralities of packages, one at a time, in succession, below one of said folded bags on the pallet bagger frame horizontal members;

locating the plastic sheet joined to the pallet base with sheet edge margins extending upwardly beyond peripheral edges of said pallet base;

opening the mouth of said one of said folded bags and slipping said one bag over the top of said pallet-borne plurality of packages down to the pallet base with the bag open edge margins extending downwardly and lying laterally opposite said upwardly extending edge margins of the plastic sheet; and affixing the plastic sheet to the open edge margins of said one bag.

2. The method of claim 1 wherein said bagger frame comprises a rotatable hub at an upper end of a vertical member with a plurality of arms extending horizontally and radially outward therefrom, and said hub is rotated to position an arm having a bag depending therefrom above said first predetermined position each time one of said plurality of pallet-borne pluralities of packages is moved to said first predetermined position.

3. The method of claim 2 wherein said hub is automatically rotated.

4. The method of claim 2 wherein said hub is manually rotated.

5. The method of claim 2 wherein each said arm is independently rotatable with respect to a vertical axis passing through the center of said vertical member, and each time one of said plurality of pallet-borne pluralities of packages is moved into said first predetermined an arm with a bag depending therefrom is rotated to a location above said first predetermined position.

6. The method of claim 5 wherein said arm is automatically rotated.

7. The method of claim 5 wherein said arm is manually rotated.

8. The method of claim 1 further comprising, before said positioning step, moving, in succession, a pluralty of support means along a conveyance path, with each of said support means carrying a plurality of said packages; periodically stopping said moving, and, during said stopping, transferring one of said plurality of packages from said support means to one of said pallets.

9. The method of claim 8 wherein said transferring includes gripping one of said plurality of packages as a unit, removing said support means from said unit during said gripping; placing said unit on said pallet; and then ceasing said gripping.

10. Apparatus for gastight sealing of a plastic bag about foodstuff containers carried on a pallet having a plastic sheet with edges extending upwardly about edges of the pallet and overlapping open edges of the bag, comprising;

first conveying means for conveying loaded pallets of a first kind one at a time to a first location;

pallet replacement means at said first location for replacing said pallets of a first kind with a pallet having a plastic sheet with edges extending upwardly about edges of the pallet;

second conveying means for conveying a loaded plastic-lined pallet to a second location;

bagging station means at said second location for facilitating the enclosure of said loaded pallet with a plastic bag with its free edges overlapping said edges of said plastic sheet;

third conveying means for conveying said loaded plastic-lined pallet base with said bag enclosing said pallet with free edges of said bag overlapping said plastic sheet to a third location; and sealing station means at said third location for hermetically sealing said bag to said plastic sheet of said pallet.

11. Apparatus as in claim 10 in which said first, second, and third conveying means comprise automatically controlled devices.

12. Apparatus as in claim 11 in which said automatically controlled devices include position sensing means for sensing the position of said loaded pallet and power switching means responsive to said position sensing means for controlling actuation of said conveying means.

13. Apparatus for gastight sealing of a plastic bag about foodstuff containers carried on a pallet having a plastic sheet with edges extending upwardly about edges of the pallet and overlapping open edges of the bag, comprising;

first conveying means for conveying loaded pallets one at a time to a first location;

squeeze station means at said first location for holding the load of a pallet so that said pallet can be removed and replaced with a plastic-lined pallet;

second conveying means for conveying said loaded plastic-lined pallet to a second location;

bagging station means at said second location including a bagger frame with horizontally rotatable arm-like extensions radiating horizontally from a central vertical member, said extensions being at a height so that plastic bags folded thereover hang down to a height above a top of a loaded pallet positioned beneath said bagger frame extensions;

third conveying means for conveying a loaded plastic-lined pallet base with a bag enclosing said pallet with free edges of said bag overlapping edges of said plastic sheet to a third location; and sealing station means for hermetically sealing said bag to said plastic sheet of said pallet.

14. Apparatus as in claim 13 in which said first, second, and third conveying means comprise automatically controlled devices.

15. Apparatus as in claim 14 in which said automatically controlled devices include position sensing means for sensing the position of said loaded pallet and power switching means responsive to said position sensing means for controlling actuation of said conveying means.

16. The apparatus of claim 13 wherein said plurality of arm-like extensions numbers about 200 and each said extension comprises an elongated member approximately 4 feet long.

17. The apparatus of claim 13 wherein said sealing station means comprises rotatable table means for rotating said pallet while said pallet is being sealed.

18. The apparatus of claim 17 wherein said rotatable table means comprises:

an upper support surface on which the pallet rests;

means for selectively rotating the table;

first and second spindle means carrying first and second rolls of tape, said tape having adhesive on one major surface;

an idler roller engaging tape from the first and second rolls urging them into adhesion along an edge margin and forming a tensioned composite tape; and a pressure roller engaging the composite tape and pressing the tape against the overlapping parts of the plastic bag and plastic sheet and an edge of the pallet during rotation of the table to effect sealing of the bag to the plastic sheet.

19. Apparatus comprising:

squeezer and pallet replacer means for temporarily supporting produce loaded on a pallet while said pallet is replaced by a plastic-lined pallet;

bag dispensing means for dispensing plastic bags;

positioner means for positioning a loaded said plastic-lined pallet beneath said bag dispensing means;

sealing means for sealing said plastic-lined pallet to one of said plastic bags with said pallet inside said bag;

atmosphere replacing means for replacing the atmosphere inside a sealed said bag; and means for moving a pallet from said squeezer and pallet replacer means to said positioner means to said sealing means to said atmosphere replacing means.

20. The apparatus of claim 19 wherein said squeezer and pallet replacer means comprises a downwardly movable floorplate and a pair of opposed vertical walls, at least one of which is movable to control the distance therebetween.

21. The apparatus of claim 19 wherein said bag dispensing means comprises a frame with a plurality of radial arms for the suspension of bags therefrom.

22. The apparatus of claim 21 wherein said arms are rotatable with respect to a vertical axis.

23. The apparatus of claim 19 wherein said positioner means comprises a conveyor belt operated by start and stop switching means.

24. The apparatus of claim 19 wherein said sealing means comprises means for sealing said plastic-lined pallet to one of said plastic bags with adhesive tape.

25. The apparatus of claim 19 wherein said atmosphere replacing means comprises:

probe means for transporting gases into or out of said plastic bag;

hose means connecting said probe means to a multiposition valve;

evacuation means including a vacuum pump connected to said valve and open to said probe means in one position of said valve for evacuating said plastic bag to a predetermined pressure below atmospheric pressure; and filling means for introducing a gas including a source of gas at a predetermined pressure connected to said valve and open to said probe means in another position of said valve, and timer means connected to said valve for controlling the length of time said valve is in said other position to introduce a predetermined volume of gas into said bag.

26. The apparatus of claim 25 wherein said valve comprises a three-way solenoid-operated valve, the third position being an "off" position.

27. The apparatus of claim 26 wherein said filling means includes a timer coupled to said solenoid-operated valve, and said evacuation means includes a pressure sensor coupled to said timer and to said solenoid-operated valve, said sensor including means for sending a signal to move said valve from said one position to said other position and for sending a start signal to said timer upon the sensing of said predetermined pressure, said timer effective to terminate the introduction of said gas at the end of a predetermined time by shutting off said valve.

28. The apparatus of claim 25 wherein said source of gas comprises:

a bottle of pressurized gas; and pressure regulation means for supplying gas at a constant pressure from said bottle to said multiposition valve.

29. The apparatus of claim 28 wherein said source of gas includes:

an additional bottle of a different pressurized gas; and an additional pressure regulation means couple to said multiposition valve, wherein said predetermined volume of gas comprises a mixture of gases.

30. The apparatus of claim 28 wherein said source of gas includes a reserve bottle of gas and said regulation means includes a pressure indicator for indicating when said reserve bottle gas is needed.

31. The apparatus of claim 20 wherein said at least one wall is hydraulically movable.

* * * * *